US007686064B2

(12) United States Patent
Gu

(10) Patent No.: US 7,686,064 B2
(45) Date of Patent: Mar. 30, 2010

(54) MOTORIZED/MANUAL CLUTCH OF CURTAIN TRACK

(75) Inventor: Duanqing Gu, Shanghai (CN)

(73) Assignee: Shanghai Qing Ying Sun-Shading Technical Development Co., Ltd., Shanghai (CN)

( * ) Notice: Subject to any disclaimer, the term of this patent is extended or adjusted under 35 U.S.C. 154(b) by 585 days.

(21) Appl. No.: 11/498,311

(22) Filed: Aug. 2, 2006

(65) Prior Publication Data

US 2007/0039700 A1 Feb. 22, 2007

(30) Foreign Application Priority Data

Aug. 17, 2005 (CN) ..... 2005 2 0044330 U

(51) Int. Cl.
*A47H 5/00* (2006.01)

(52) U.S. Cl. ..... 160/341; 160/344; 160/345; 160/340; 160/168.1 V; 160/124; 160/331; 192/69.62; 16/87.2

(58) Field of Classification Search ..... 160/341, 160/344, 345, 340, 168.1 V, 124, 331; 192/69.62; 16/87.2, 87.6 R, 87.8, 91, 93 R
See application file for complete search history.

(56) References Cited

U.S. PATENT DOCUMENTS

| | | | | | |
|---|---|---|---|---|---|
| 2,231,305 | A | | 2/1941 | Vallen | |
| 3,753,457 | A | * | 8/1973 | Bratschi | 160/331 |
| D266,143 | S | | 9/1982 | Smith | |
| 4,492,262 | A | * | 1/1985 | Comeau | 160/126 |
| 4,495,671 | A | * | 1/1985 | Comeau et al. | 16/87 R |
| 4,519,433 | A | * | 5/1985 | Comeau | 160/126 |
| 4,683,935 | A | * | 8/1987 | Arquati | 160/331 |
| 4,785,866 | A | * | 11/1988 | Darner | 160/345 |
| 5,791,394 | A | * | 8/1998 | Huang | 160/345 |
| 5,967,217 | A | | 10/1999 | Wu | |
| 6,085,826 | A | * | 7/2000 | Maesaki | 160/345 |
| 6,138,324 | A | | 10/2000 | Lin | |
| 6,405,782 | B1 | * | 6/2002 | Cheng | 160/168.1 P |
| 6,820,306 | B2 | * | 11/2004 | Huang | 16/102 |
| 6,827,121 | B2 | * | 12/2004 | Park | 160/331 |
| 6,886,218 | B2 | * | 5/2005 | ter Braak | 16/87 R |
| 6,935,403 | B2 | * | 8/2005 | Killo et al. | 160/331 |
| 6,994,145 | B2 | * | 2/2006 | Killo et al. | 160/331 |
| 7,293,762 | B2 | * | 11/2007 | Hoffend, Jr. | 254/394 |
| 7,337,825 | B1 | * | 3/2008 | Erbe | 160/331 |
| 7,360,576 | B2 | * | 4/2008 | Lin | 160/331 |
| 7,446,280 | B2 | * | 11/2008 | Zamuner | 219/137.31 |

(Continued)

*Primary Examiner*—Katherine W Mitchell
*Assistant Examiner*—Philip S Kwon
(74) *Attorney, Agent, or Firm*—Dorsey & Whitney LLP

(57) ABSTRACT

A motorized and manual clutch of curtain track, set on a curtain track, the curtain track is provided with a belt which is driven by motor and carrier hook parts which are used to hang curtain. The motorized and manual clutch is composed of a clutch body module and a clutch bar module, the clutch body module and said clutch bar module are detachably connected. A gap is provided on the belt, the clutch body module is set in the gap, connected with the belt and moved with the belt. The clutch bar module is set under the clutch body module connected with the carrier hook parts and moves the carrier hook parts. The application of the new practical motorized and manual clutch of curtain track solves the operation problem when power cut or breakdown motor or electrical circuit. It further improves the practical value of motorized curtain track.

3 Claims, 8 Drawing Sheets

U.S. PATENT DOCUMENTS

| | | | | |
|---|---|---|---|---|
| 7,484,712 | B2 * | 2/2009 | Hossler | 254/331 |
| 2003/0106653 | A1 * | 6/2003 | Braak | 160/331 |
| 2003/0121622 | A1 * | 7/2003 | Killo et al. | 160/331 |
| 2008/0105390 | A1 * | 5/2008 | Vrielink | 160/341 |
| 2009/0255086 | A1 * | 10/2009 | Wicker et al. | 16/87.8 |

* cited by examiner

MOTORIZED/MANUAL CLUTCH OF CURTAIN TRACK

TECHNICAL FIELD

The invention relates to a curtain, especially to a motorized and manual clutch of curtain track.

BACKGROUND ART

The prevailing motorized curtain in current market will happen following situation when power cut or breakdown on motor and electrical circuit: when curtain is open, close is not available; when curtain is close or during operation, neither open nor continue operation. The situation brings trouble to users and is bad for spreading application of motorized curtain.

SUMMARY OF THE INVENTION

The invention aims to provide a motorized and manual clutch of curtain track, make it possible to manually operate curtain when power cut.

The technical solution of this invention is: a motorized and manual clutch of curtain track set on a curtain track, the curtain track is provided with a belt which is driven by a motor and carrier hook parts which are used to hang curtain, the motorized and manual clutch is composed of a clutch body module and a clutch bar module, the clutch body module and the clutch bar module are detachably connected. A gap is provided on the belt, the clutch body module is set in the gap, connected with the belt and moved with the belt. The clutch bar module is set under the clutch body module, connected with the carrier hook parts and moves the carrier hook parts.

In the motorized and manual clutch mentioned above, the clutch body module is composed of a clutch body and two connectors, a hole is provided in the middle of the clutch body, the two connectors are connected with the clutch body and the belt which are disposed at both sides of the hole.

In the motorized and manual clutch mentioned above, the clutch bar module is composed of a connector body, a clutch bar, a sewing bar and a carrier group. The connector body is hung on the track by the carrier group which is installed on the connector body, and is connected with the carrier hook parts. The connector body is provided with a through hole which is adapted with the hole on the clutch body, and a slot for permitting movement of the sewing bar. The upper end of the clutch bar is inserted into the through hole on the connector body and extended upwardly into the hole of the clutch body, one end of the sewing bar is set in the slot of the connector body and is rotatably connected with the connector body, a middle part of the sewing bar and a lower part of the clutch bar rotatably connected to move the clutch bar up and down.

In the motorized and manual clutch mentioned above, a space for permitting upward movement of the end part of the sewing bar is disposed inside the slot on the connector body.

In the motorized and manual clutch mentioned above, a carrier bearing is mounted on the upper part of the clutch bar.

In the motorized and manual clutch mentioned above, a spring nested on the clutch bar which applies a force on the sewing bar that rotatably connected to the lower part of the clutch bar.

In the motorized and manual clutch mentioned above, the middle part of the sewing bar is provided with a waist-shaped hole which extends in a movement direction of the clutch bar so that the lower part of the clutch bar moves and/or revolves in the waist-shaped hole.

The application of the new practical motorized and manual clutch of curtain track solves the operation problem when power cut or breakdown motor or electrical circuit. It further improves the practical value of motorized curtain track.

PREFERABLE MODE OF CARRYING OUT THE INVENTION

Example 1

Figure 1:
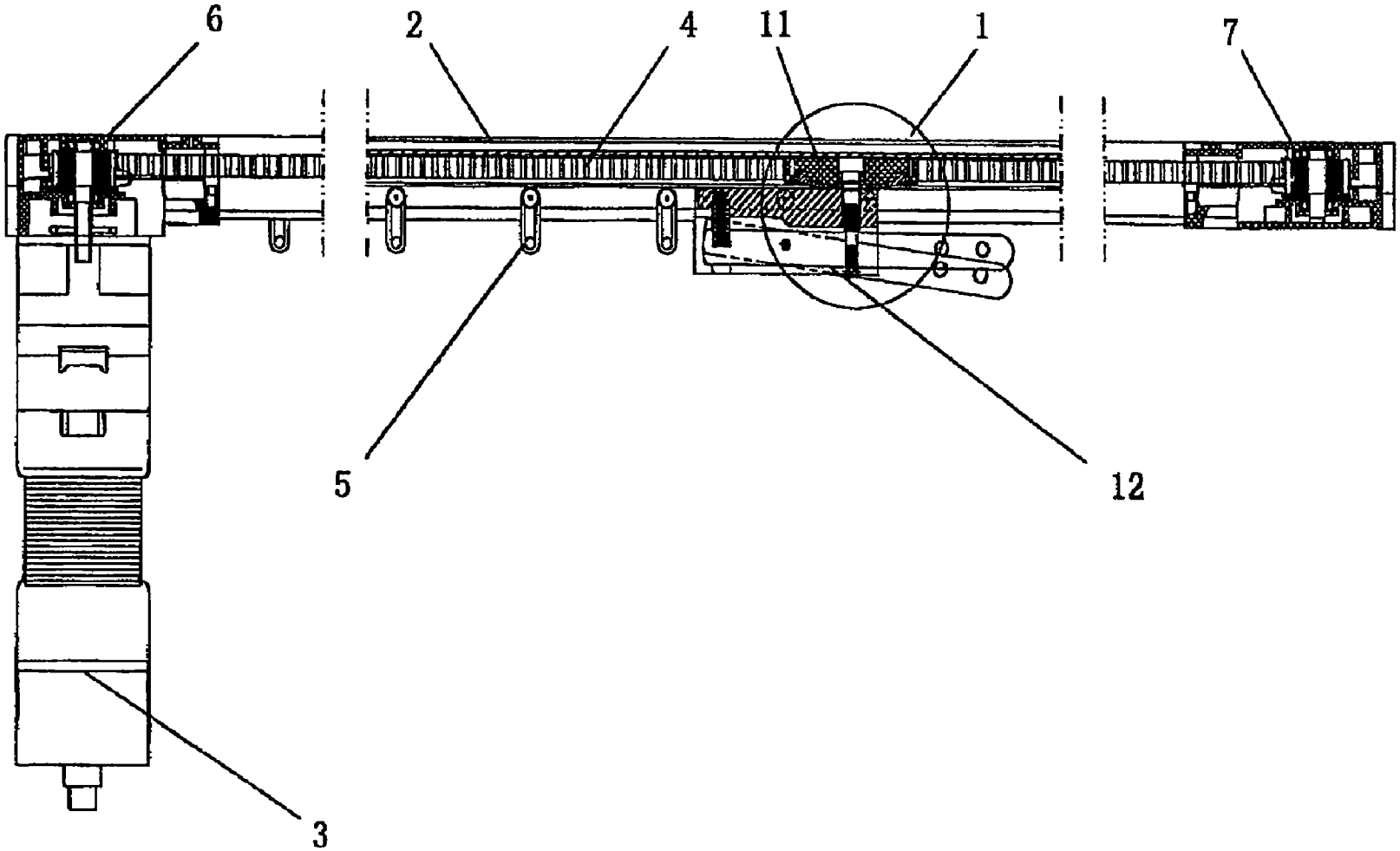
FIG. 1: Main structure illustration of motorized curtain track with the motorized and manual clutch for example 1 (motorized state)

See FIG. 1, In example 1, the motorized and manual clutch of curtain track 1, set on a curtain track 2, the track is provided with a belt 4 which is driven by a motor 3 and carrier hook parts 5 which are used to hang curtain. As shown in FIG. 1, reference numeral 6 represents a drive box, and reference numeral 7 represents an end box.

Refer to FIG. 1 again, in example 1, the motorized and manual clutch 1 is composed of a clutch body module 11 and a clutch bar module 12, the clutch body module 11 and the clutch bar module 12 are detachably connected. A gap 41 is provided on the belt 4, the clutch body module 11 is set in the gap, connected with the belt and moved with the belt. The clutch bar module 12 is set under the clutch body module 11, connected with the carrier hook parts 5 and moves the carrier hook parts.

Figure 2:
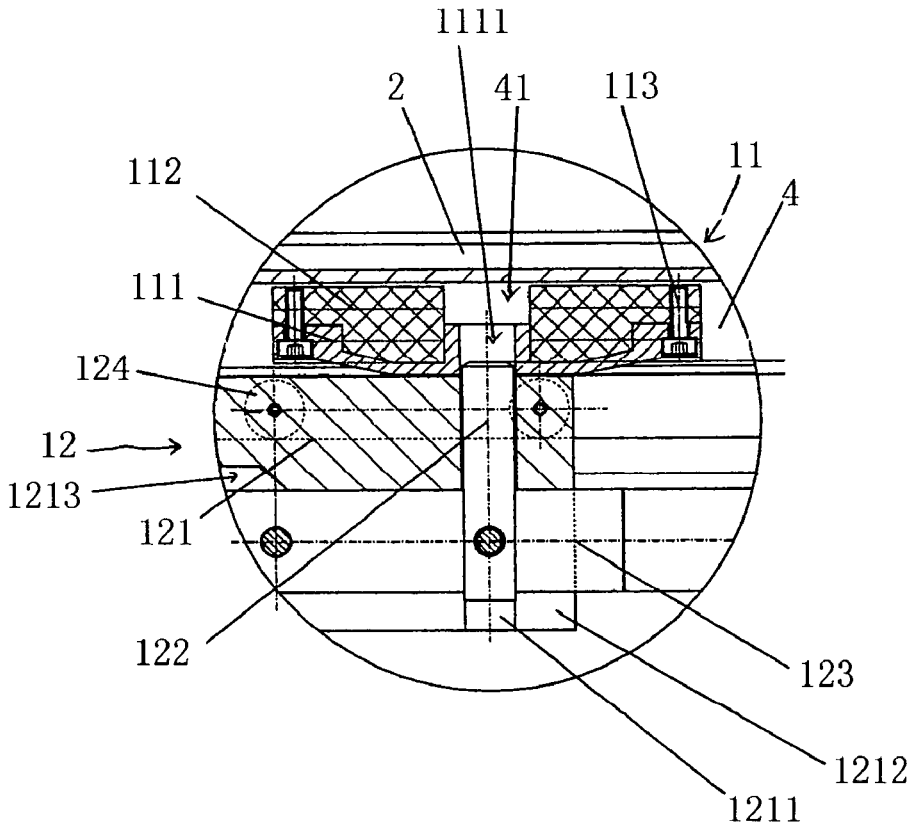
FIG. 2: Structure illustration of the motorized and manual clutch in state 1.

See FIG. 2, In example 1, the mentioned clutch body module 11 is composed of a clutch body 111 and two connectors 112, a hole 1111 is provided in the middle of the clutch body 111, the two connectors 112 are connected with the clutch body 111 and the belt 4 which are disposed at both sides of the hole by a fixer 113. The clutch body module bridges the gap of the belt between two distal ends of the belt, the clutch body module being moved with the belt.

Refer to FIG. 2 again, In example 1, the mentioned clutch bar module 12 is composed of a connector body 121, a clutch bar 122, a sewing bar 123 and a carrier group 124. The connector body 121 is hung on the track 2 by the carrier group 124 which is installed on the connector body 121, and is connected with the carrier hook parts. The connector body 121 is provided with a through hole 1211 which is adapted with the hole 1111 on the clutch body, and a slot 1212 for permitting movement of the sewing bar. A space 1213 for permitting upward movement of the end part of the sewing bar is disposed inside the slot 1212 on the connector body 121. The upper part of the clutch bar 122 is inserted into the through hole 1211 on the connector body 121 and extended upwardly into the hole 1111 of the clutch body 111, one end of the sewing bar 123 is set in the slot 1212 of the connector body and is rotatably connected with the connector body 121, the slot 1212 for receiving the sewing bar 123 is disposed in the lower part of the clutch bar 122. The middle part of the sewing bar 123 is inserted into the slot, and is rotatably connected to the lower part of the clutch bar 122 so that the clutch bar 122 moves up and down.

FIG. 1 and FIG. 2 show the motorized state of this new curtain track in example 1. At this moment, the clutch bar 122 of the clutch bar module 12 is projected into the hole 1111 on the clutch body 111, the clutch body module 11 is connected with the clutch bar module 12. Turn on power and press switch, the motor 3 will revolve and drive the belt 4 to move in the double track, and the clutch 1 which carries curtain will move with the belt 4, so the track system will be operated.

Figure 3:
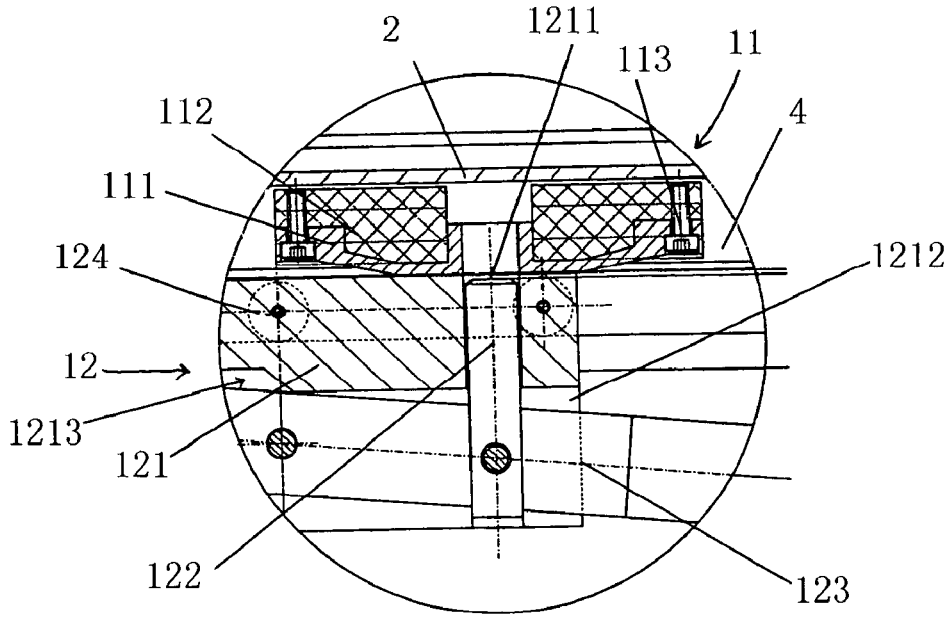
FIG. 3: Structure illustration of the motorized and manual clutch for example 1 (separate sewing bar state)

See FIG. 3, it is the separate state of the swing bar 123 on the motorized and manual clutch in example 1. At this moment, the clutch bar 122 of the clutch bar module 12 is moved out of the hole 1111 of the clutch body 111, the clutch body module 11 and the clutch bar module 12 are disconnected. So it can be manually operated. When the motor is broken, the swing bar 123 is pulled downwardly by hand to separate the clutch bar 122 from the clutch body 111, thus the curtain can be opened and closed at any position by hand from any position.

Figure 4:
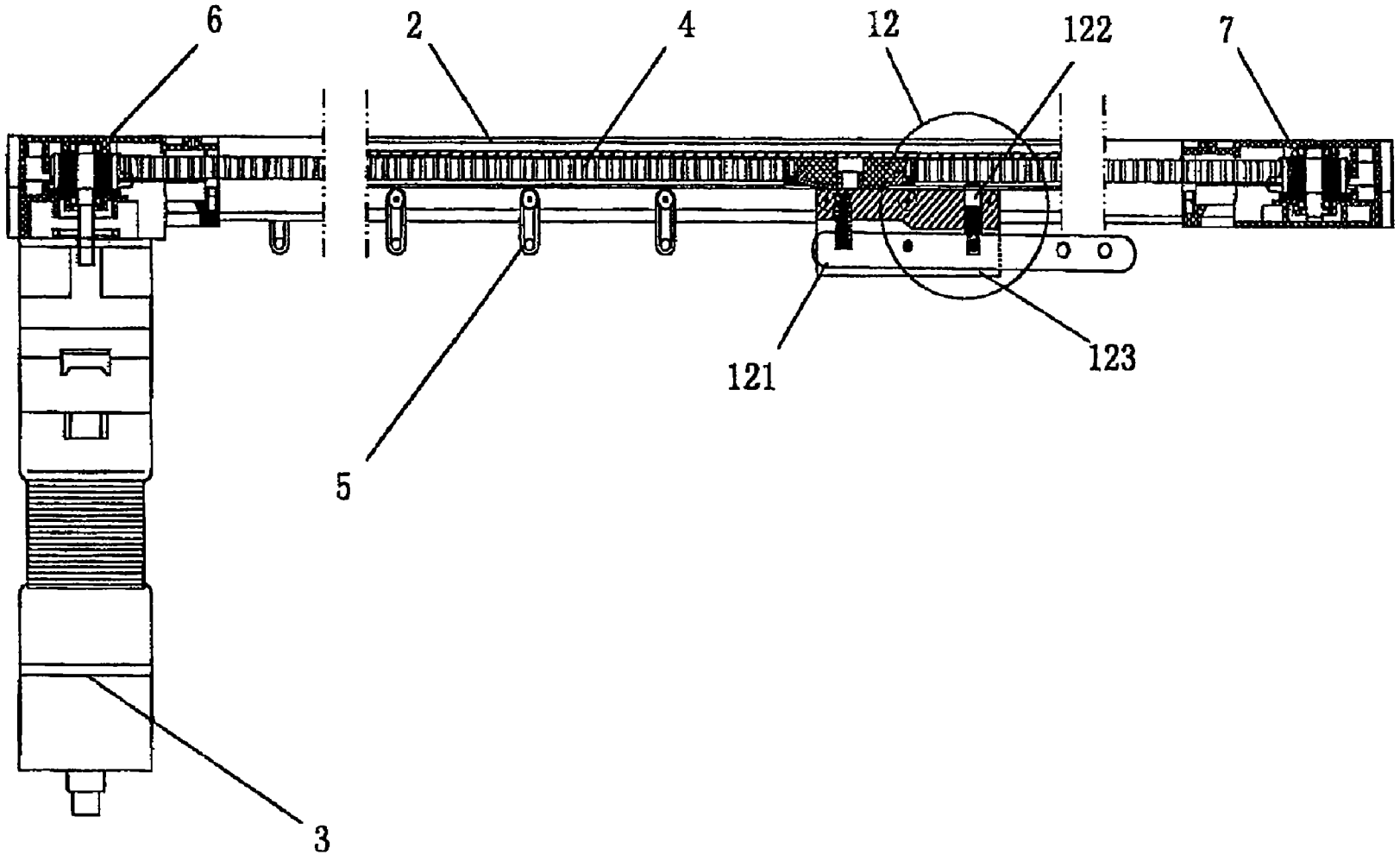
FIG. 4: Main structure illustration of motorized curtain track with the motorized and manual clutch for example 1 (manual control state)
Figure 5:
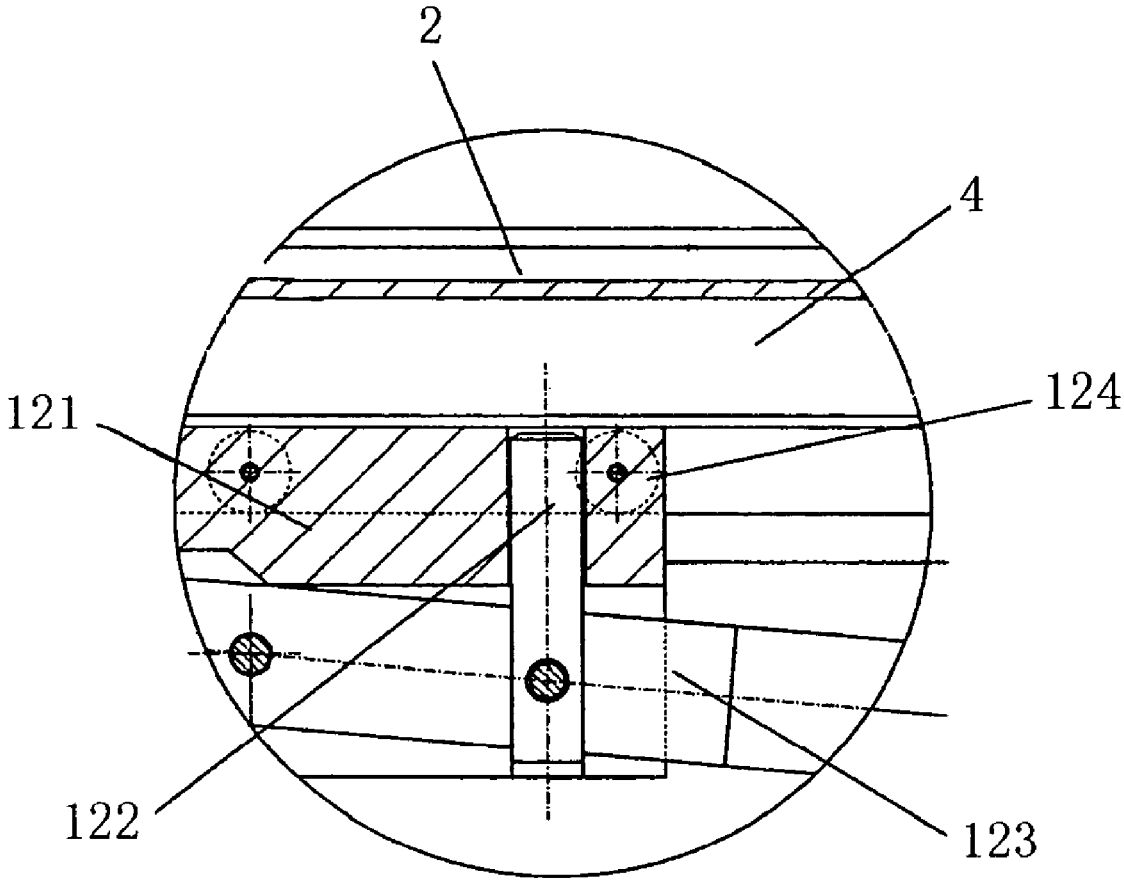
FIG. 5: Structure illustration of the motorized and manual clutch in state 4.

See FIGS. 4 & 5, they show a separate state of the motorized and manual clutch in manual operation state in example 1. At this moment, the clutch bar 122 of the clutch bar module 12 is moved out of the hole 1111 on the clutch body 111, the clutch body module 11 and the clutch bar module 12 are disconnected. Now just translate the swing bar 123 horizontally to operate the curtain open and close. In FIG. 4, the clutch body module 11 and the clutch bar module 12 are in different positions. In FIG. 5, the belt 4 is set above the clutch bar module 12, but not the clutch body module 11.

Example 2

Figure 6:
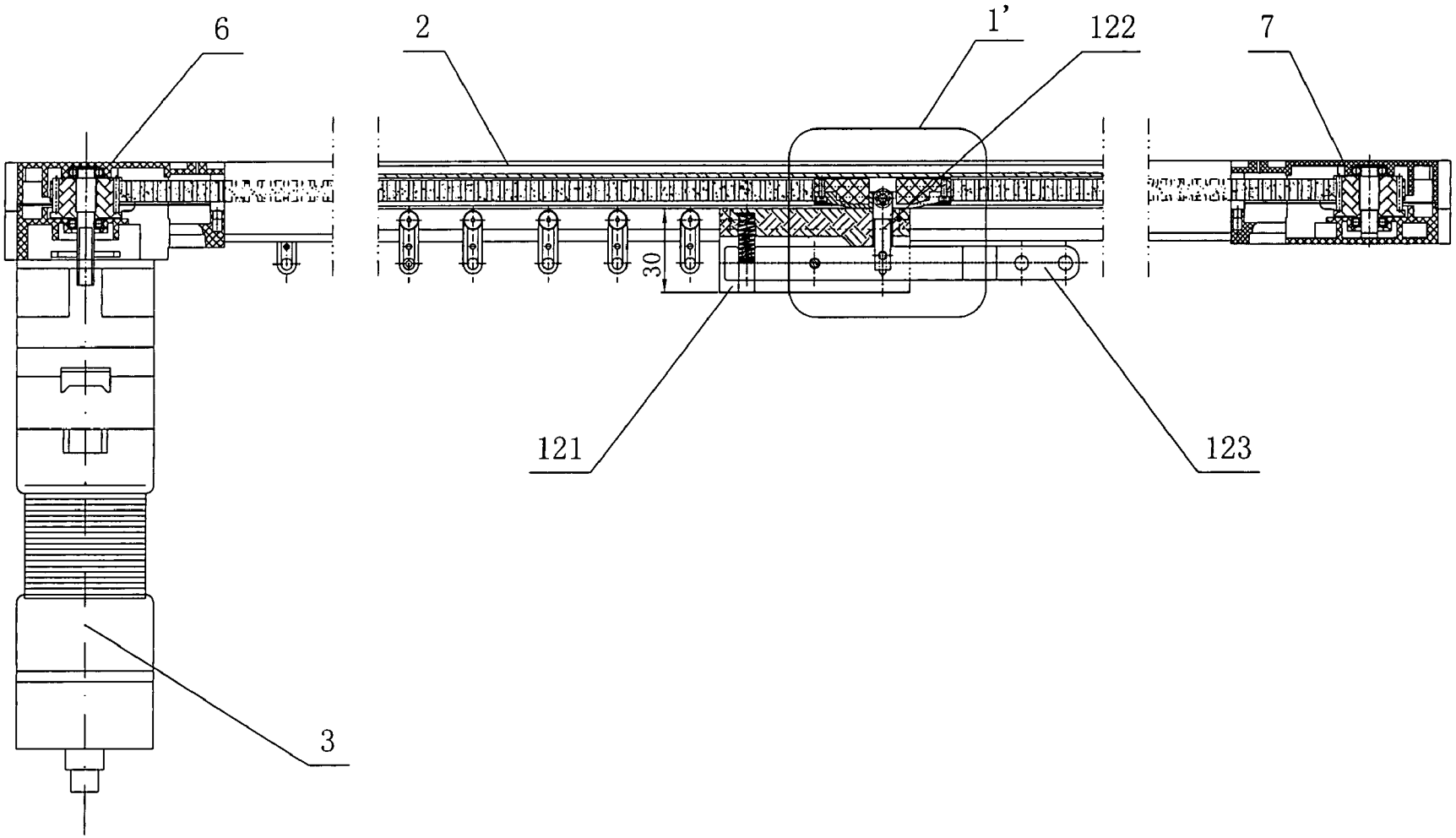
FIG. 6: Main structure illustration of motorized curtain track with the motorized and manual clutch for example 2 (motorized state)
Figure 9:
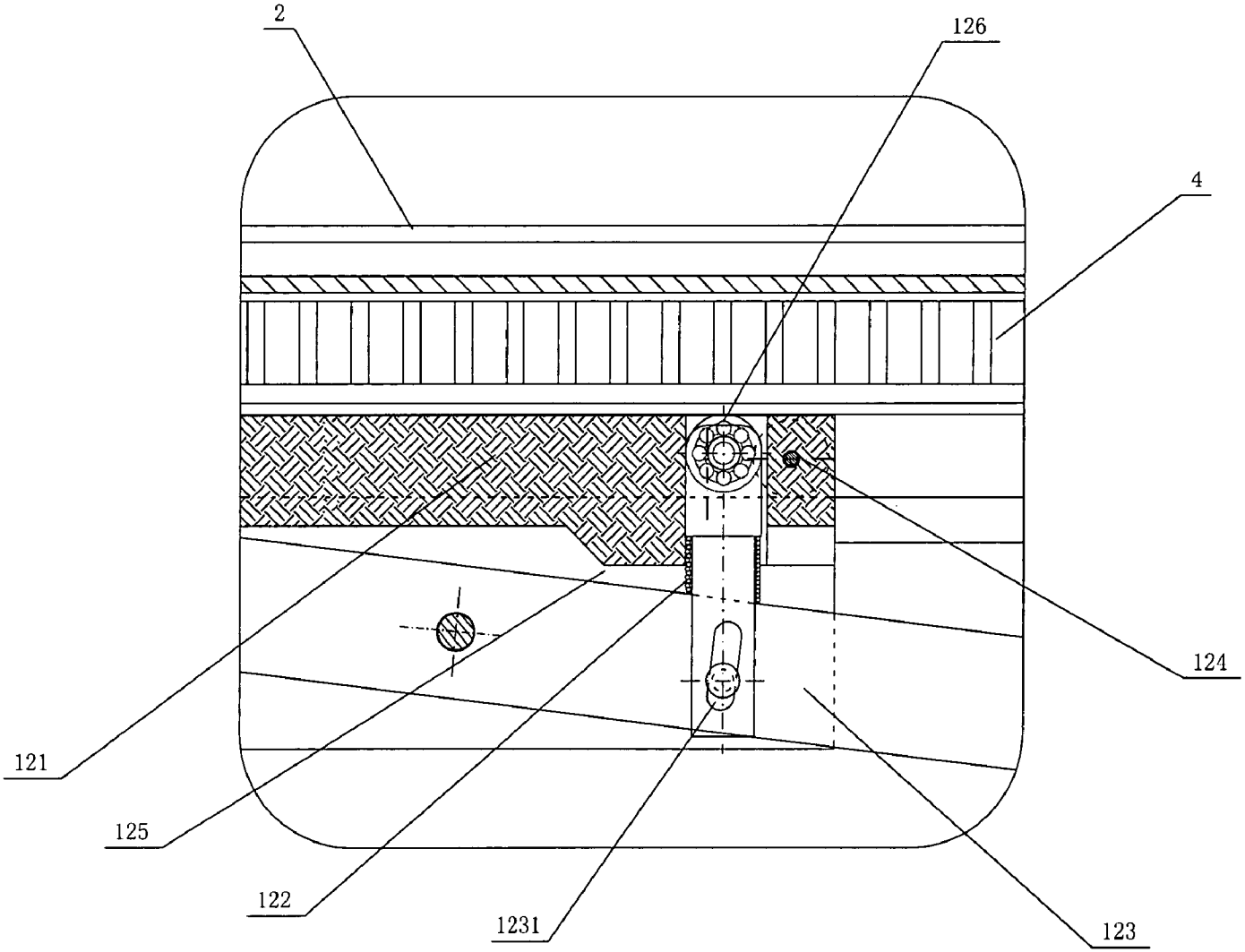
FIG. 9: similar with FIG. 5, illustration of the motorized and manual clutch.

FIG. 6 and FIG. 9, example 2, show the motorized state and manual state of the motorized and manual clutch of curtain track. They are corresponding to FIG. 1 to FIG. 3 and FIG. 5.

The following are the different structure of the motorized and manual clutch in example 2 from example 1.

Figure 7:
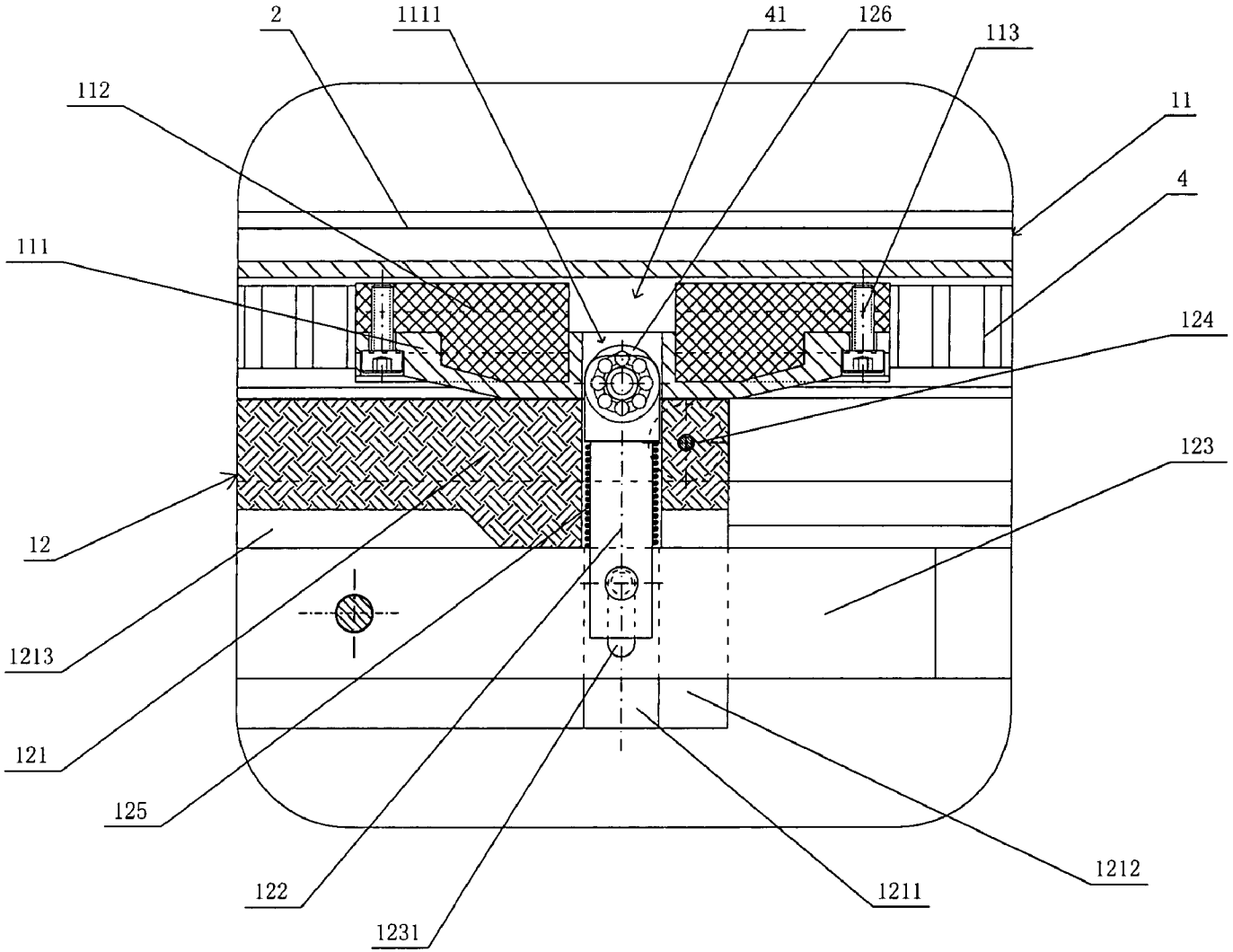
FIG. 7: Structure illustration of the motorized and manual clutch in state 6.
Figure 8:
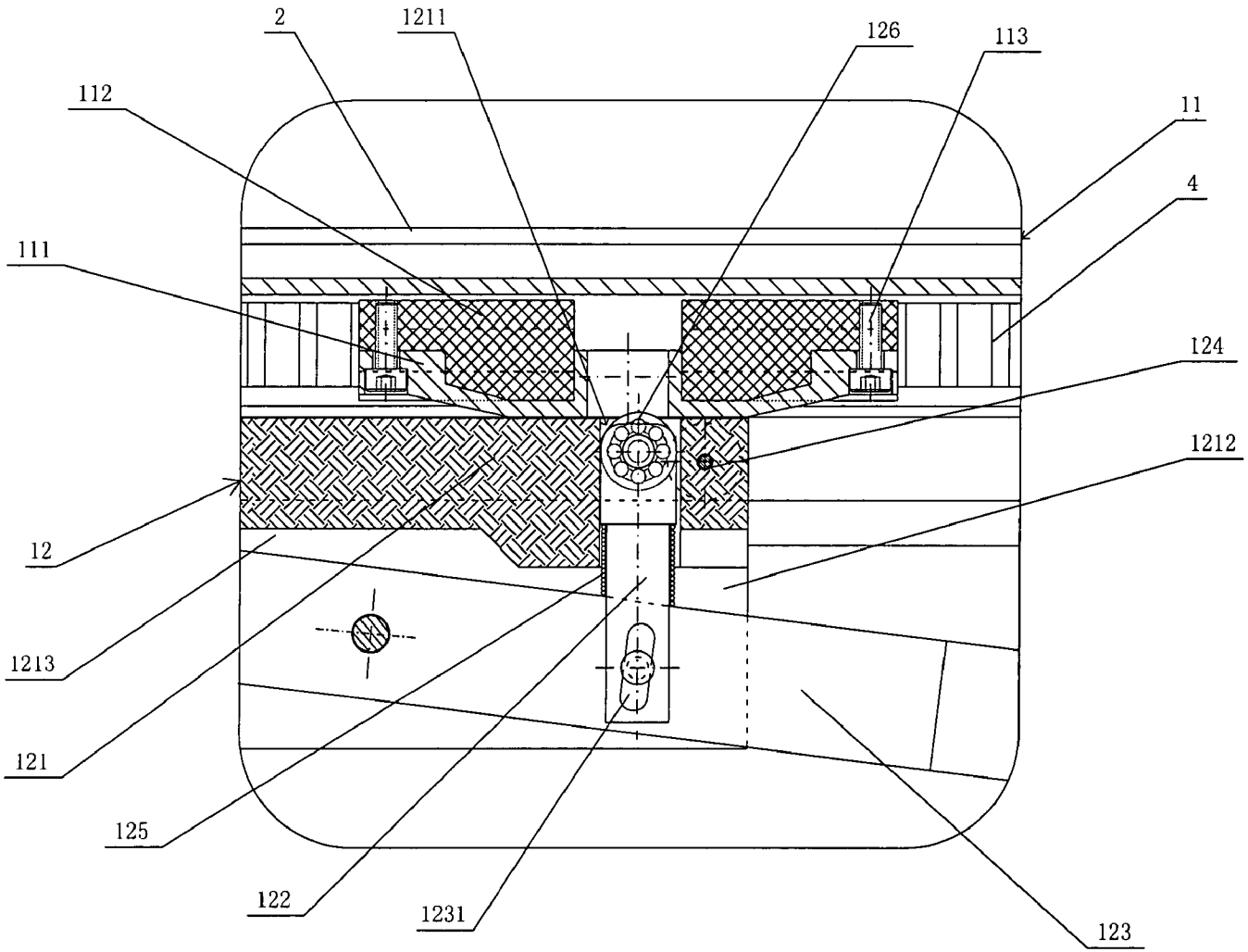
FIG. 8: Structure illustration of the motorized and manual clutch for example 2 (separate sewing bar state)

Refer to FIG. 7, it shows the difference of motorized and manual clutch structure between example 1 and example 2:

(1) A carrier bearing 126 is mounted on the upper part of the clutch bar 122 so that the upper part of the clutch bar 122 can insert into the through hole 1211 of the connector body 121 easily and extended upwardly into the hole 1111 of the clutch body 111.

(2) A spring 125 is nested on the middle part of the clutch bar 122, refer to FIG. 7, the spring 125 is disposed at the connecting part of the carrier bearing 126, the clutch bar 122 and the sewing bar 123. In common, if the sewing bar 123 can sustain weight of curtain, it can always keep operation state under the force of the spring 125.

(3) The middle part of the sewing bar 123 is provided with a waist-shaped hole 1231 which extends in a movement direction of the clutch bar, so that the lower part of the clutch bar 122 moves and/or revolves up and down in the waist-shaped hole 1231, thus ensures enough space for the movement of the clutch bar 122.

When the belt 4 is moving, the connector body 121 touches the carrier bearing 126 mounted on the upper part of the clutch bar 122, so that the carrier bearing 126 is inserted into the hole 1111 of the clutch body 111 gradually under the force of the spring 125. At this moment, the sewing bar 123 finishes the connection operation of the clutch body module 11 and the clutch bar module 12 in its horizontal level condition. In order to separate the clutch body module 11 and the clutch bar module 12, the sewing bar 123 is pulled downwardly so that the carrier bearing 126 of the clutch bar 122 is moved out of the hole 1111. Under the force of spring 125, the carrier bearing 126 on the upper part of the clutch bar 122 withstands the double track all the time.

The invention claimed is:

1. A motorized and manual clutch of a curtain track, comprising:

a belt disposed on the curtain track, the belt being driven by the motor;

a plurality of carrier hook parts to hang a curtain;

a clutch body module;

a clutch bar module, the clutch body module and the clutch bar module being detachably connected;

a gap being disposed in the belt, the clutch body module bridging the gap of the belt between two distal ends of the belt, the clutch body module being moved with the belt;

wherein the clutch bar module is disposed under the clutch body module and connected with the plurality of carrier hook parts and moves the carrier hook parts;

wherein the clutch body module comprises a clutch body, a plurality of connectors, a hole disposed in the clutch body, wherein the plurality of connectors are connected with the clutch body and the belt; and wherein the clutch bar module comprises a connector body, a clutch bar, a sewing bar and a carrier group, the connector body is hung on the curtain track by the carrier group which is installed on the connector body, the connector body is connected with the carrier hook parts, a through hole is disposed in the connector body and is adapted with the hole in the clutch body, a slot for permitting movement of the sewing bar, an upper end of the clutch bar is inserted into the through hole on the connector body and extended upwardly into the hole of the clutch body, one end of the sewing bar is disposed in the slot of the connector body and is rotatably connected with the connector body, and a middle part of the sewing bar and a lower part of the clutch bar are rotatably connected to move the clutch bar up and down.

2. The motorized and manual clutch of claim 1, wherein the plurality of connectors include two connectors, the two connectors are connected with the clutch body and the belt which are disposed on both sides of the hole of the clutch body, respectively.

3. The motorized and manual clutch of claim 1, wherein a space for permitting upward movement of the one end of the sewing bar is disposed in the slot of the connector body.

* * * * *